US008562254B2

(12) United States Patent
Dimillo

(10) Patent No.: US 8,562,254 B2
(45) Date of Patent: Oct. 22, 2013

(54) DOOR ARRANGEMENT FOR A TUNNELING MACHINE

(76) Inventor: Tony Dimillo, Newmarket (CA)

( * ) Notice: Subject to any disclaimer, the term of this patent is extended or adjusted under 35 U.S.C. 154(b) by 0 days.

(21) Appl. No.: 12/533,787

(22) Filed: Jul. 31, 2009

(65) Prior Publication Data

US 2010/0028084 A1 Feb. 4, 2010

Related U.S. Application Data

(60) Provisional application No. 61/086,155, filed on Aug. 4, 2008.

(51) Int. Cl.
*E21D 9/08* (2006.01)

(52) U.S. Cl.
USPC ..... 405/144

(58) Field of Classification Search
USPC ..... 405/144; 49/40; 160/352, 211, 222, 160/223, 57
See application file for complete search history.

(56) References Cited

FOREIGN PATENT DOCUMENTS

FR 2589516 A1 * 5/1987
JP 2002129886 A * 5/2002

* cited by examiner

*Primary Examiner* — Sunil Singh

(57) ABSTRACT

The present invention provides a door arrangement for a tunneling machine. The door arrangement is for location at the front of the tunneling machine adjacent to the digging end of the machine. The door arrangement allows for the interior of the machine to be sealed off from the tunnel face, while also allowing for the door arrangement to be opened and allow complete access to the tunnel face. The door arrangement comprises door sections for hinged connection to a tunneling machine, the door sections being pivotable about the hinged connection between a closed position sealing the tunneling machine and an open position allowing the tunneling machine access to a tunnel face.

9 Claims, 4 Drawing Sheets

DOOR ARRANGEMENT FOR A TUNNELING MACHINE

FIELD OF THE INVENTION

The present invention relates to a door arrangement for tunneling machines to close off the machine from the working face of the tunnel being dug.

BACKGROUND OF THE INVENTION

Various apparatus have been used for removing earth in a tunneling operation including the use of remotely controlled boring apparatus which are basically augers, to the use of digging machines such as back hoe type equipment. While such tunneling machines provide for flexibility and production in the digging of tunnels, they do suffer drawbacks especially in certain soil conditions. In unstable soil conditions or where the soil is saturated with moisture, there can be soil creep, which can reduce the efficiency of the digging operation. The situation especially arises if for example, the machine has been left at the tunnel face overnight. In some circumstances, it may be necessary to remove the soil creep before the tunneling operation can continue. Alternatively in such situations it may be necessary to provide for continuous operation of the machine.

In addition, should it be necessary to work on the machine for maintenance this may require that the machine be either backed away from the face or removed entirely from the tunnel. Otherwise the presence of the potential for the soil creep at the face of the tunnel may interfere with the maintenance operations of the machine.

There thus remains a need for a apparatus for a tunneling machine to overcome the above disadvantages of the prior art.

SUMMARY OF THE INVENTION

The present invention provides a door arrangement for a tunneling machine. The door arrangement is for location at the front of the machine adjacent to the digging end of the machine. The door arrangement allows for the interior of the machine to be sealed off from the tunnel face, while also allowing for the door arrangement to be opened and allow complete access to the tunnel face.

In an aspect of the invention the door arrangement comprises door sections for hinged connection to a tunneling machine, the door sections being pivotable about the hinged connection between a closed position sealing the tunneling machine and an open position allowing the tunneling machine access to a tunnel face.

In another aspect of the invention the door sections are semi-circular shaped segments of the surface of a sphere.

In an aspect of the invention there is provided a tunneling machine having a door arrangement, located at the front of the machine adjacent to the digging end of the machine. The tunneling machine comprises a housing having a front end and a rear end and being sized for the tunnel to be dug. The housing on the interior is provided with a digging implement at the front end to remove material from a tunnel face and a conveying means to move the removed material to the rear end of the machine to be transported away. The door arrangement comprises door sections for hinged connection to the casing of the tunnel digging machine, the door sections being pivotable about the hinged connection between a closed position sealing the front end of the tunneling machine and an open position allowing the digging implement at the front end of the tunneling machine access to a tunnel face.

BRIEF DESCRIPTION OF THE DRAWINGS

Preferred embodiments of the present invention are shown in the drawings wherein.

DETAILED DESCRIPTION OF THE PREFERRED EMBODIMENTS

Figure 1:
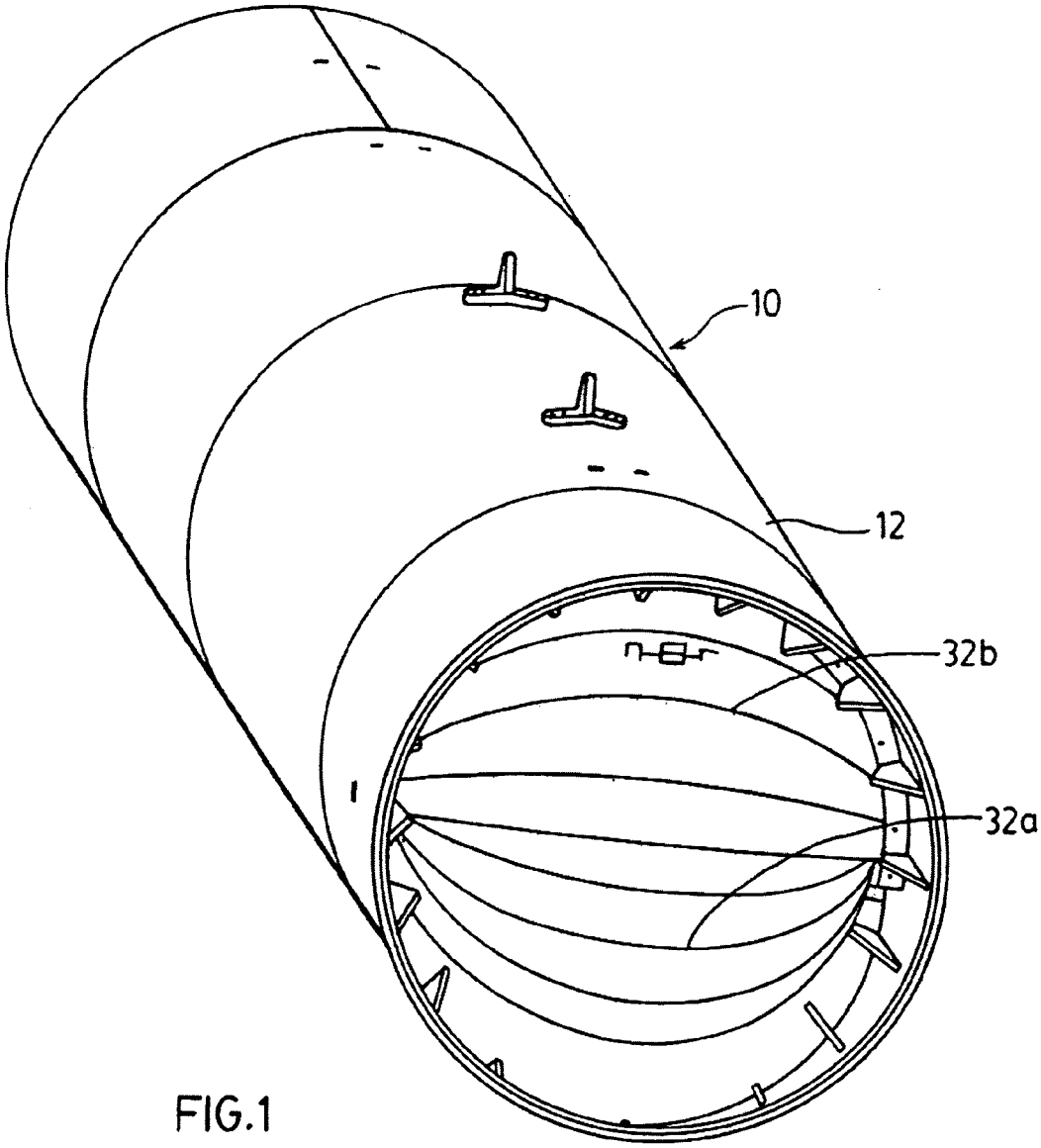
FIG. 1 is a perspective view of a tunnel digging machine having the door arrangement of the present invention.
Figure 2:
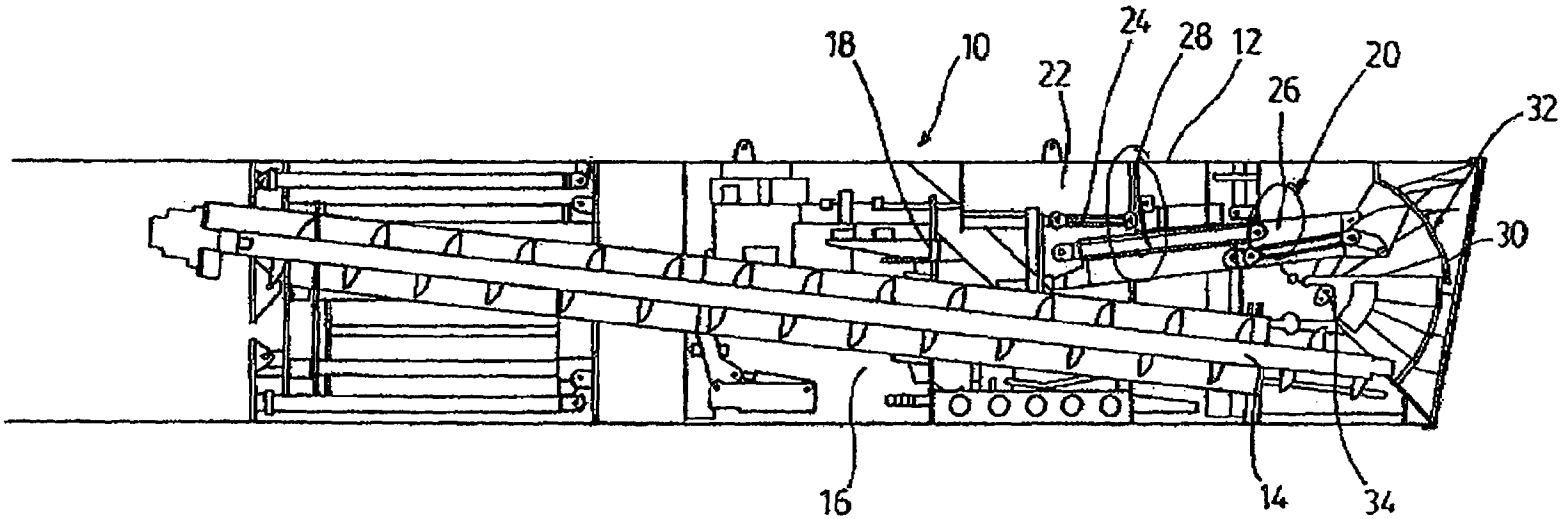
FIG. 2 is a side elevation view in cross section of the tunnel digging machine of FIG. 1.
Figure 3:
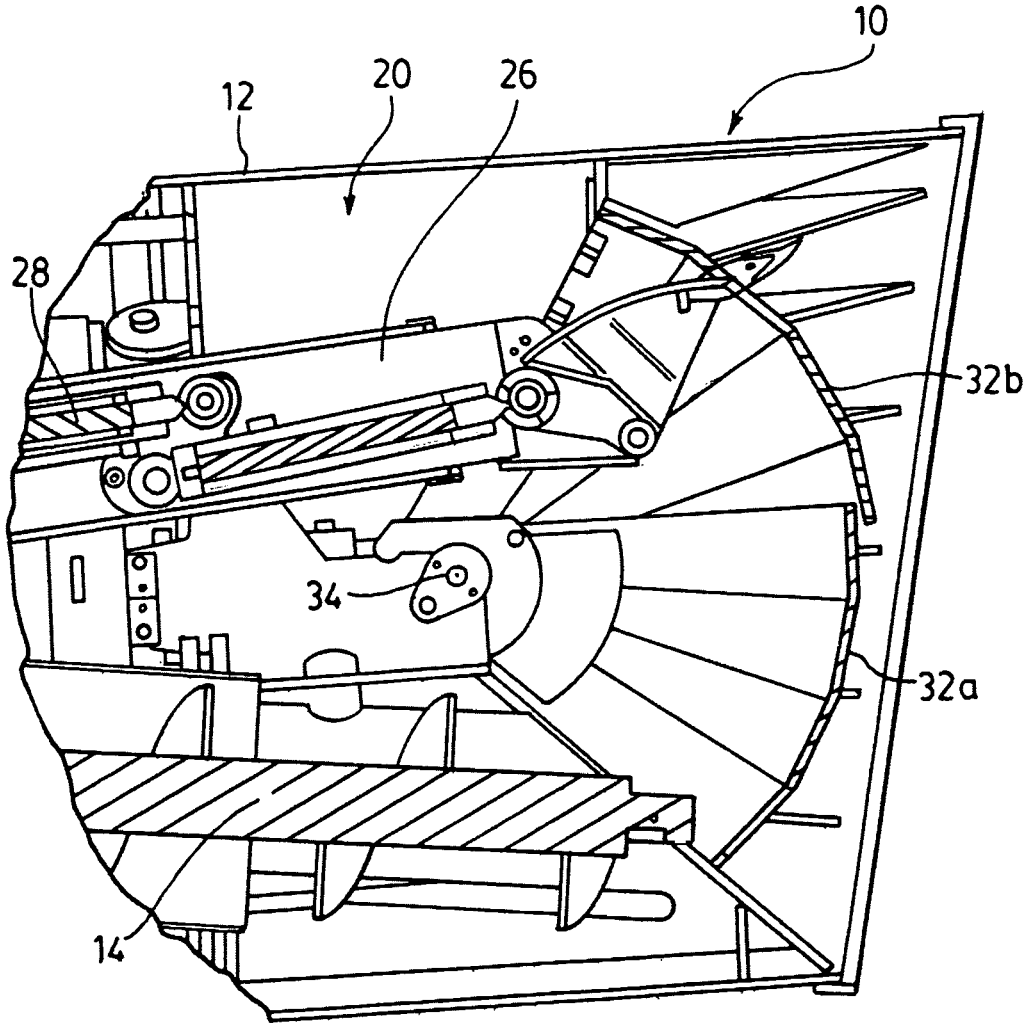
FIG. 3 is an enlarged side elevation view in cross section of the front end of the tunnel digging machine of FIG. 1.
Figure 4:
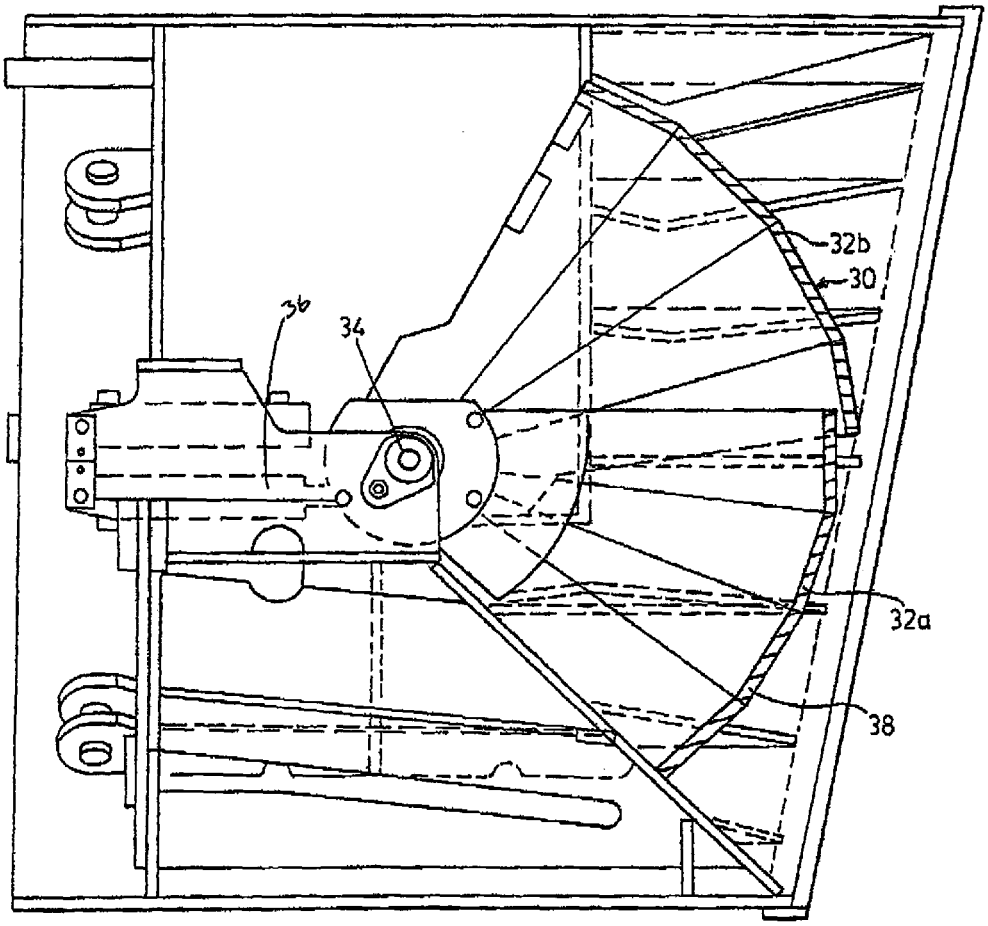
FIG. 4 is an enlarged side elevation view in cross section of the door arrangement of the tunnel digging machine of FIG. 1.

The present invention provides a door arrangement for a tunneling machine for location at the front of the machine adjacent to the digging end of the machine. The door arrangement allows for the interior of the machine to be sealed off from the tunnel face, while also allowing for the door arrangement to be opened and allow complete access to the tunnel face. The door arrangement has door sections for hinged connection to a tunneling machine, the door sections being pivotable about the hinged connection between a closed position sealing the tunneling machine and an open position allowing the tunneling machine access to a tunnel face. Preferably, the door sections are semi-circular shaped segments of the surface of a sphere.

The door arrangement may be employed with any of the commonly utilized tunneling machines such as tunnel digging machines or tunnel boring machines. The following description refers to a tunnel digging machine but the present invention is not limited thereto.

A tunnel digging machine having the door arrangement of the present invention is illustrated in the attached figures generally indicated by the numeral 10. The tunnel digging machine 10 has an outer casing 12 sized for the tunnel to be dug as well as to protect the operator and machinery. Contained within the casing 12 is a conveyor means, preferably an auger 14 running the length of the tunnel digging machine 10 for transporting the debris of the tunnel digging operation rearwardly through the machine 10.

The tunnel digging machine 10 is provided with an operator's platform 16, which may include a seat for the operator. The tunnel digging machine 10 is also provided with a bulkhead 18, in the interior of the casing to provide for a working space 20 between the front of the bulkhead 18 and the front end of the tunnel digging machine 10. The operator's platform 16 is provided to the rear of the bulkhead 18 which includes a window through which the operator may observe the digging operation. In this way, the operator is shielded from the digging operation at the tunnel face and protected form any hazardous conditions which may arise during the digging operation.

In order to increase the protection of the operator, the working space 20 may be pressurized by a source of pressurized or compressed air. The pressurization of the working space 20 helps to prevent seepage of moisture which may be entrapped in the soil being removed from the tunnel face as well as reducing soil creep.

A boom support table 22 is attached to the interior of the casing 12, the boom support table 22 being supported on the casing 12 by means of a rotatable connection, which allows the boom support table 22 to rotate. The rotation of the boom support table 22 is achieved by the action of hydraulic cylinders 24, which are located on either side of the tunnel digging machine 10. One end of the hydraulic cylinder 24 is attached to the casing 12 while the second end is attached to the boom support table 22. Actuation of the hydraulic cylinders 24 moves the boom support table 22 from side to side in the horizontal plane to allow a boom 26 attached to the boom support table 22 to reach the sidewalls of the tunnel during the digging operation. The boom support table 22 also supports the boom 26 in a manner to permit the boom 26 to move up and down as well as to permit the boom 26 to rotate along its longitudinal axis. The boom 26 at either side is attached to the boom support table 22 by a journal connection. Hydraulic cylinders 28 having one end attached to the boom 26 and the other end attached to the boom support table 22 also connect the boom 26 to the boom support table 22. Actuation of the hydraulic cylinders 28 rotates the boom 26 about the journal connection moving the boom 26 up and down.

A number of different digging implements may be used with the machine of the present invention. Such digging implements include excavation buckets, mucking buckets, pneumatic or hydraulic rock drills, hammers, etc. The digging implements are attached to the end of the boom 27 in a manner to permit quick interchangeability such that the implement may be exchanged in a short period of time, typically on the order of about 15 minutes. This is accomplished in one embodiment by attaching the implement to the end of the boom 28 by shafts having a threaded end and securing the shaft by a suitable bolt.

The working space 20 of the tunnel digging machine 10 is provided with a door arrangement 30 to allow the working space 20 at the front-end to be closed off from the face of the tunnel to allow for control of the ingress of material into the tunnel digging machine 10 or to allow for maintenance of the tunnel digging machine 10. Preferably as illustrated in the drawings, the door arrangement 30 includes doors sections 32, which are preferably semi-circular shaped segments of the surface of a sphere and which are connected at either side to the sidewall of the casing of the tunnel digging machine 10. This allows the door sections 32 to be rotated about the connection 34 such that they may be moved upwardly into the interior of the tunnel digging machine 10 to allow for full access to the face of the tunnel by the tunnel digging machine 10. The door sections 32 may also be rotated partially closed to control the amount of material which can creep or seep into the tunnel digging machine 10 so that the auger conveyor apparatus 14 is capable of handling this amount of material. The door sections 32 are also able to be fully closed to close off the working space 20 at the front of the tunnel digging machine 10, either during periods of inactivity or for maintenance of the tunnel digging machine 10. The rotation of the door sections 32 is controlled by one or more hydraulic cylinders 36 attached to the door sections 32 adjacent the pivot point 34. Preferably both sides of the door sections 32 are provided with a hydraulic cylinder 36. In a preferred embodiment, the end of the hydraulic cylinder 36 is attached to only the lower door section 32*a* and the upper door section 32*b* is linked to the lower door section 32*a* such that as the hydraulic cylinder 36 is activated and the lower door section 32*a* moves, it moves the upper door section 32*b* along with it.

In the preferred embodiment illustrated, each of the doors sections 32 are formed of a plurality of metal plates 38, which are bent and cut to form the segments of the sphere. These plurality of metal plates 38, are then welded one to another to form the doors sections 32. While the embodiment illustrated in the figures shows two such doors sections 32, more than two sections may also be utilized.

In order to allow for the doors sections 32 to be moved upwardly and open the entire front-end of the tunnel digging machine 10 to the tunnel face it is preferred if the doors sections 32 stack one above the other when the doors sections 32 are in the fully open position. Thus is illustrated in the figures, with the two doors sections 32 of the preferred embodiment, the lower door section 32*a* passes to the inside of the upper door section 32*b* to allow for both door sections 32 to be stored at the top of the tunnel digging machine 10 when the doors sections 32 are in the open position. Alternatively, the two door sections may be provided in a clam-shell type arrangement where the upper door section pivots upwardly in the open position and the lower door section pivots downwardly. This may be accomplished by providing separate hydraulic cylinders for each door section or by a linkage arrangement between the two door sections connected to a single hydraulic cylinder.

The door arrangement for the tunneling machine of the present invention provides for increased operation and efficiency of the tunneling and mining operations. By closing off the door arrangement and sealing off the front-end of the tunneling machine from the tunnel face in times of inactivity, the possibility of material from the tunnel creeping into the tunneling machine is greatly reduced or eliminated. In this way during the startup operation, the doors are partially opened to allow any material which may have accumulated at the front end of the machine to be removed by the auger apparatus prior to the doors being opened completely to continue with the digging operation. In addition should rocks be encountered during the digging operation, which are too large for the auger apparatus to handle, the doors may be closed off to allow for the operator to enter the front-end of the machine to reduce the rocks to a size which may be handled by the auger apparatus. The door arrangement of the present invention also allows for control of the digging operation as the doors may be partially closed to limit the amount of the tunnel face exposed to the digging machine. This may be particularly advantageous in unstable soil conditions, particularly those containing entrapped water or other fluids where the amount of material entering the machine may be such that the conveyor apparatus would not be able to remove it quickly enough. In addition, the door arrangement of the present invention also allows the front-end of the tunneling machine to be closed off from the tunnel face to allow routine or other maintenance to be performed on the machine.

While the door arrangement has been described for use with a tunnel digging machine, it will be appreciated that such a door arrangement may also be utilized with other types of tunneling machines such as tunnel boring machines. In addition, the door arrangement of the present invention has utility in other applications. For example, the door arrangement may be provided in tunnels through which fluid flows to control the flow of the fluid. Thus, the door arrangement may be provided in a water or storm water pipe or tunnel. The doors may be closed to block the flow when maintenances is being performed. In another possible application, the door arrangement may be provided in mine tunnels to seal off sections of the mine. Other applications will be apparent to those skilled in the art.

Although various preferred embodiments of the present invention have been described herein in detail, it will be appreciated by those skilled in the art, that variations may be made thereto without departing from the spirit of the invention or the scope the appended claims.

The embodiments of the invention in which an exclusive property or privilege is claimed are as follows:

1. A door arrangement for a tunneling machine for location at the front of the tunneling machine adjacent to the digging end of the machine, the door arrangement being movable between a closed position sealing the interior of the tunneling machine and an open position allowing the tunneling machine access to a tunnel face the door arrangement comprising a plurality of individual door sections, each of the individual door sections spanning the width of the interior of the tunneling machine and being pivotably mounted at each end by a pivotable connection to opposite sides of the tunneling machine, and each of the individual door sections being rotatable about the pivotable connections in the same direction between the dosed position sealing the tunneling machine and the open position allowing the tunneling machine access to a tunnel face the door sections rotatable upwardly to the open position, a lower door section passing to the inside of an upper door section to be stacked one upon the other in the open position.

2. The door arrangement according to claim 1 wherein the individual door sections are semi-circular shaped segments of the surface of a sphere.

3. The door arrangement according to claim 2 wherein two semi-circular shaped door sections are provided.

4. The door arrangement according to claim 1 wherein a single hydraulic cylinder is attached to the door arrangement to enable the movement of the door arrangement between the closed and open position.

5. The door arrangement according to claim 4 wherein the individual door sections are semi-circular shaped segments of the surface of a sphere.

6. A tunneling machine having a door arrangement located at the front of the machine adjacent to the digging end of the machine, the tunneling machine comprising a housing having a front end and a rear end and being sized for the tunnel to be dug, the housing on the interior being provided with a digging implement at the front end to remove material from a tunnel face and a conveying means to move the removed material to the rear end of the machine to be transported away, the door arrangement comprising a plurality of individual door sections, each individual door section spanning the width of the interior of the tunneling machine and being pivotably mounted at each end by pivotable connections to opposite sides of the casing of the tunneling machine, the individual door sections being rotatable about the pivotable connections in the same direction between a closed position sealing the front end of the tunneling machine and an open position allowing the digging implement at the front end of the tunneling machine access to a tunnel face the door sections rotatable upwardly to the open position, a lower door section passing to the inside of an upper door section to be stacked upon each other in the open position.

7. A tunneling machine according to claim 6 wherein the machine is provided with a bulkhead in the interior of the casing to provide a working space between the front of the bulkhead and the front end of the machine and a operator position to the rear of the bulkhead.

8. A tunneling machine according to claim 7 wherein a source of compressed air is provided to the working space to pressurize the working space.

9. A tunneling machine as claimed in claim 8 wherein the digging implement is provided on a telescopic boom rotatably mounted to the interior of the casing forward of the bulkhead to permit rotation of the boom in a horizontal plane, the boom further being movable in a vertical plane and rotatable about a longitudinal axis of the boom.

* * * * *